US007497664B2

(12) United States Patent
Walter et al.

(10) Patent No.: US 7,497,664 B2
(45) Date of Patent: Mar. 3, 2009

(54) METHODS AND APPARATUS FOR REDUCING VIBRATIONS INDUCED TO AIRFOILS

(75) Inventors: Robert A. Walter, Melrose, MA (US); David Christensen, Newbury, MA (US); Caroline Curtis Granda, Concord, MA (US); Jeffrey Nussbaum, Wilmington, MA (US); Anna Wei, Swampscott, MA (US); Michael Macrorie, Winchester, MA (US); Tara Chaidez, Malden, MA (US)

(73) Assignee: General Electric Company, Schenectady, NY (US)

( * ) Notice: Subject to any disclaimer, the term of this patent is extended or adjusted under 35 U.S.C. 154(b) by 592 days.

(21) Appl. No.: 11/204,718

(22) Filed: Aug. 16, 2005

(65) Prior Publication Data

US 2007/0041841 A1 Feb. 22, 2007

(51) Int. Cl.
*F01D 5/14* (2006.01)

(52) U.S. Cl. ..... 416/223 A; 416/DIG. 5

(58) Field of Classification Search ..... 416/DIG. 5, 416/223 A, 243, 238
See application file for complete search history.

(56) References Cited

U.S. PATENT DOCUMENTS 4,108,573 A 8/1978 Wagner
4,589,824 A 5/1986 Kozlin
4,720,239 A 1/1988 Owezarek
5,261,789 A 11/1993 Butts et al.
5,269,057 A 12/1993 Mendham
6,164,914 A 12/2000 Correia et al.
6,179,556 B1 1/2001 Bunker
6,241,474 B1 * 6/2001 Alizadeh et al. ..... 416/DIG. 5
6,299,412 B1 10/2001 Wood et al.
6,382,913 B1 5/2002 Lee et al.
6,503,053 B2 1/2003 Huebner
6,524,070 B1 2/2003 Carter
6,905,309 B2 6/2005 Nussbaum et al.

* cited by examiner

*Primary Examiner*—Richard Edgar
(74) *Attorney, Agent, or Firm*—Willam Scott Andes, Esq

(57) ABSTRACT

Methods and apparatus for fabricating a rotor blade for a gas turbine engine are provided. The rotor blade includes an airfoil having a first sidewall and a second sidewall, connected at a leading edge and at a trailing edge. The method includes forming the airfoil portion bounded by a root portion at a zero percent radial span and a tip portion at a one hundred percent radial span, the airfoil having a radial span dependent chord length C, a respective maximum thickness T, and a maximum thickness to chord length ratio ($T_{max}$/C ratio), forming the root portion having a first $T_{max}$/C ratio, forming the tip portion having a second $T_{max}$/C ratio, and forming a mid portion extending between a first radial span and a second radial span having a third $T_{max}$/C ratio, the third $T_{max}$/C ratio being less than the first $T_{max}$/C ratio and the second $T_{max}$/C ratio.

25 Claims, 9 Drawing Sheets

METHODS AND APPARATUS FOR REDUCING VIBRATIONS INDUCED TO AIRFOILS

STATEMENT REGARDING FEDERALLY SPONSORED RESEARCH OR DEVELOPMENT

The U.S. Government may have certain rights in this invention pursuant to contract number N00019-99-C-11175 Engineering Support CLIN 0114.

BACKGROUND OF THE INVENTION

This application relates generally to gas turbine engine rotor blades and, more particularly, to methods and apparatus for reducing vibrations induced to rotor blades.

Gas turbine engine rotor blades typically include airfoils having leading and trailing edges, a pressure side, and a suction side. The pressure and suction sides connect at the airfoil leading and trailing edges, and span radially between the airfoil root and the tip. An inner flowpath is defined at least partially by the airfoil root, and an outer flowpath is defined at least partially by a stationary casing. For example, at least some known compressors include a plurality of rows of rotor blades that extend radially outwardly from a disk or spool.

Known compressor rotor blades are cantilevered adjacent to the inner flowpath such that a root area of each blade is thicker than a tip area of the blades. More specifically, because the tip areas are thinner than the root areas, and because the tip areas are generally mechanically unrestrained, during operation wake pressure distributions may induce chordwise bending or other vibrational modes into the blade through the tip areas. Vibratory stresses, especially chordwise bending stresses (stripe modes), may be localized to the blade tip region. Over time, high stresses may cause tip cracking, corner loss, downstream damage, performance losses, reduced time on wing, and/or high warranty costs. Moreover, continued operation with chordwise bending or other vibration modes may limit the useful life of the blades.

To facilitate reducing tip vibration modes, and/or to reduce the effects of a resonance frequency present during engine operations, at least some known vanes are fabricated with thicker tip areas. However, increasing the blade thickness may adversely affect aerodynamic performance and/or induce additional radial loading into the rotor assembly. Accordingly, to facilitate reducing tip vibrations without inducing radial loading, at least some other known blades are fabricated with a shorter chordwise length in comparison to the above described known blades. However, reducing the chord length of the blade may also adversely affect aerodynamic performance of the blades.

BRIEF DESCRIPTION OF THE INVENTION

In one embodiment a method for fabricating a rotor blade for a gas turbine engine is provided. The rotor blade includes an airfoil having a first sidewall and a second sidewall, connected at a leading edge and at a trailing edge. The method includes forming the airfoil portion bounded by a root portion at a zero percent radial span and a tip portion at a one hundred percent radial span, the airfoil having a radial span dependent chord length C, a respective maximum thickness T, and a maximum thickness to chord length ratio ($T_{max}$/C ratio), forming the root portion having a first $T_{max}$/C ratio, forming the tip portion having a second $T_{max}$/C ratio, and forming a mid portion extending between a first radial span and a second radial span having a third $T_{max}$/C ratio, the third $T_{max}$/C ratio being less than the first $T_{max}$/C ratio and the second $T_{max}$/C ratio.

In another embodiment, an airfoil for a gas turbine engine is provided. The airfoil includes a radial span dependent chord length C, a respective maximum thickness T, and a maximum thickness to chord length ratio ($T_{max}$/C ratio), the airfoil further including a first sidewall, a second sidewall coupled to said first sidewall at a leading edge and at a trailing edge, a root portion at a zero percent radial span having a first $T_{max}$/C ratio, a tip portion at a one hundred percent radial span having a second $T_{max}$/C ratio, and a mid portion extending between a first radial span and a second radial span having a third $T_{max}$/C ratio, the third $T_{max}$/C ratio being less than the first $T_{max}$/C ratio and the second $T_{max}$/C ratio.

In yet another embodiment, a gas turbine engine including a plurality of rotor blades is provided. Each rotor blade includes an airfoil having radial span dependent chord length C, a respective maximum thickness T, and a maximum thickness to chord length ratio ($T_{max}$/C ratio), wherein the airfoil further includes a first sidewall, a second sidewall coupled to said first sidewall at a leading edge and at a trailing edge, a root portion at a zero percent radial span having a first $T_{max}$/C ratio, a tip portion at a one hundred percent radial span having a second $T_{max}$/C ratio, and a mid portion extending between a first radial span and a second radial span having a third $T_{max}$/C ratio, the third $T_{max}$/C ratio being less than the first $T_{max}$/C ratio and the second $T_{max}$/C ratio.

DETAILED DESCRIPTION OF THE INVENTION

Figure 1:
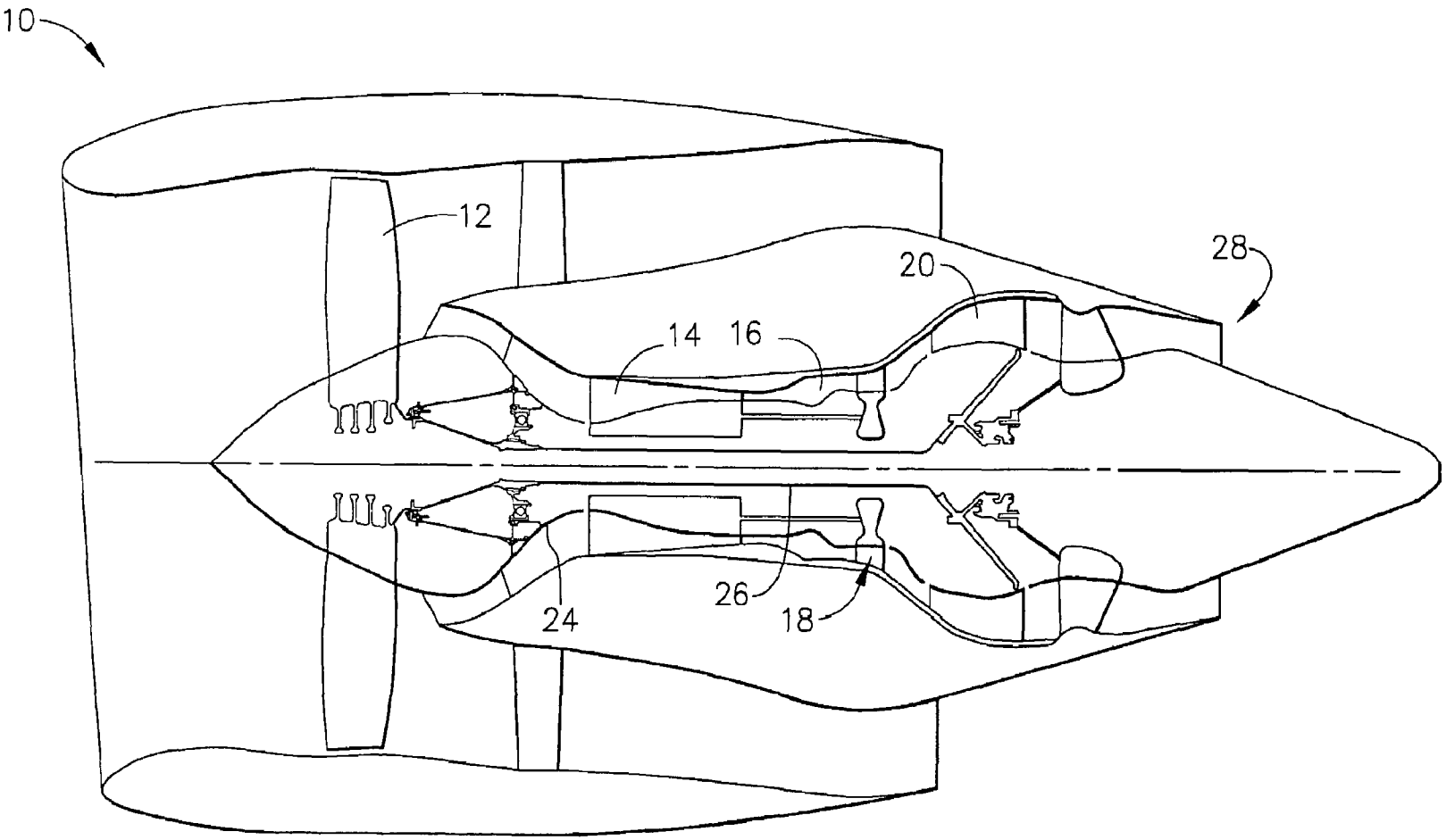
FIG. 1 is schematic illustration of a gas turbine engine.

FIG. 1 is a schematic illustration of a gas turbine engine 10 including a fan assembly 12, a high pressure compressor 14, and a combustor 16. In one embodiment, engine 10 is a CF34 engine available from General Electric Company, Cincinnati, Ohio. Engine 10 also includes a high pressure turbine 18 and a low pressure turbine 20. Fan assembly 12 and turbine 20 are coupled by a first shaft 24, and compressor 14 and turbine 18 are coupled by a second shaft 26.

In operation, air flows through fan assembly 12 and compressed air is supplied from fan assembly 12 to high pressure compressor 14. The highly compressed air is delivered to combustor 16. Airflow from combustor 16 drives rotating turbines 18 and 20 and exits gas turbine engine 10 through an exhaust system 28.

Figure 2:
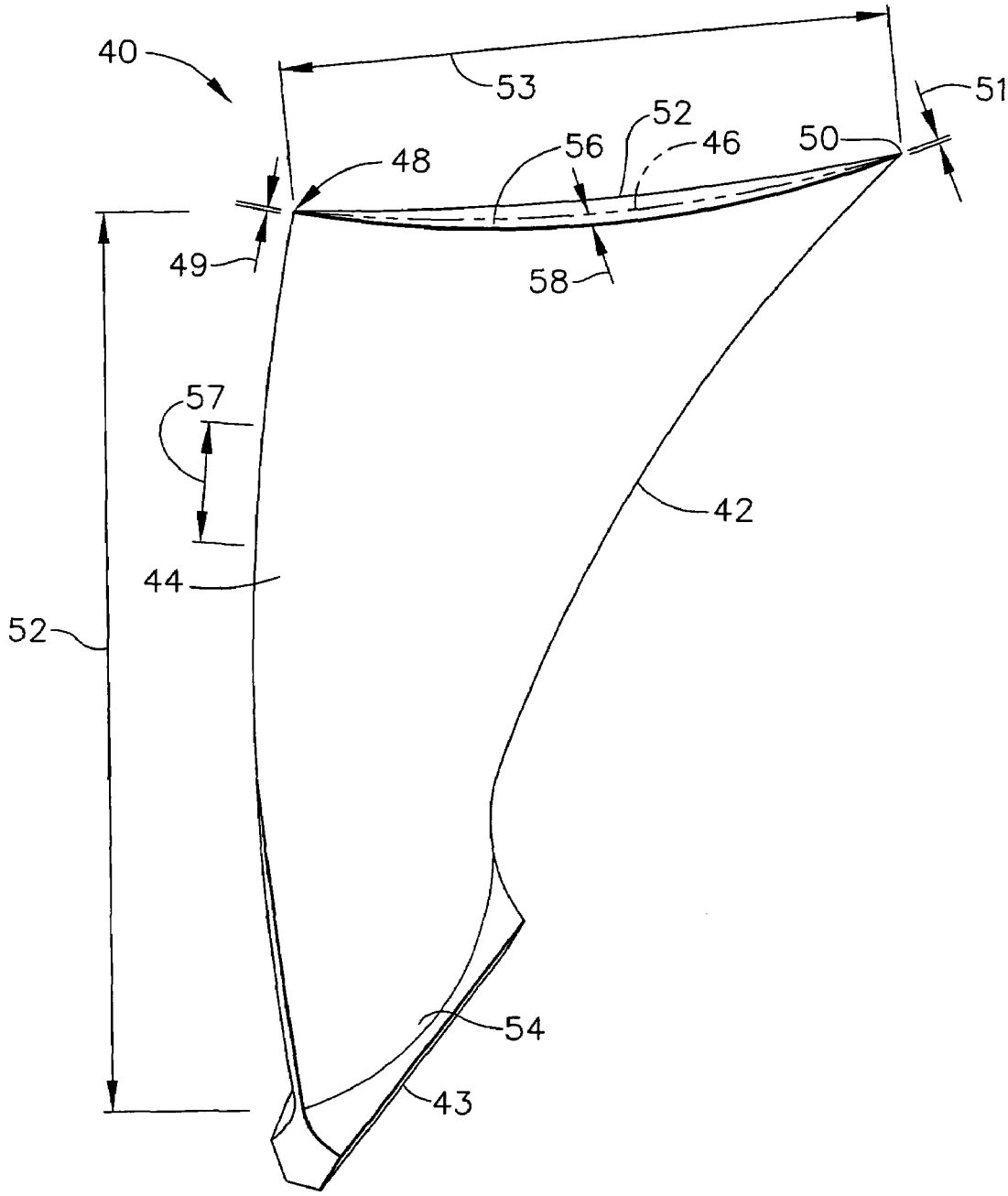
FIG. 2 is a perspective view of a rotor blade that may be used with the gas turbine engine shown in FIG. 1.

FIG. 2 is a partial perspective view of an exemplary rotor blade 40 that may be used with a gas turbine engine, such as gas turbine engine 10 (shown in FIG. 1). In one embodiment, a plurality of rotor blades 40 form a high pressure compressor stage (not shown) of gas turbine engine 10. Each rotor blade 40 includes an airfoil 42 and an integral dovetail 43 used for mounting airfoil 42 to a rotor disk (not shown). Alternatively, blades 40 may extend radially outwardly from a disk (not shown), such that a plurality of blades 40 form a blisk (not shown).

Each airfoil 42 includes a first contoured sidewall 44 and a second contoured sidewall 46. First sidewall 44 is convex and defines a suction side of airfoil 42, and second sidewall 46 is concave and defines a pressure side of airfoil 42. Sidewalls 44 and 46 are joined at a leading edge 48 having a thickness 49 and at an axially-spaced trailing edge 50 having a thickness 51. A chord 52 of airfoil 42 includes a chord length 53 that represents the distance from leading edge 48 to trailing edge 50. More specifically, airfoil trailing edge 50 is spaced chordwise and downstream from airfoil leading edge 48. First and second sidewalls 44 and 46, respectively, extend longitudinally or radially outward in a span 52 from a blade root 54 positioned adjacent dovetail 43, to an airfoil tip 56. Radial span 52 may be graduated in increments of percent of full span from blade root 54 to airfoil tip 56. A mid portion 57 of blade 40 may be defined at a cross-section of blade 40 at an selectable increment of span or may be defined as a range of cross sections between two increments of span. A maximum thickness 58 of airfoil 42 may be defined as the value of the greatest distance between sidewalls 44 and 46 at an increment of span 52.

A shape of blade 40 may be at least partially defined using chord length 53 (C) at a plurality of increments of chord length, the respective maximum thickness 58 ($T_{max}$), and a maximum thickness ($T_{max}$) to chord length (C) ratio ($T_{max}$/C ratio), which is the local maximum thickness divided by the respective chord length at that increment of span. These values may be dependent on the radial span of the location where the measurement are taken because the chord length and maximum thickness values may vary from blade root 54 to blade tip 56.

During fabrication of blade 40, a core (not shown) is cast into blade 40. The core is fabricated by injecting a liquid ceramic and graphite slurry into a core die (not shown). The slurry is heated to form a solid ceramic core. The core is suspended in a turbine blade die (not shown) and hot wax is injected into the turbine blade die to surround the ceramic core. The hot wax solidifies and forms a turbine blade with the ceramic core suspended in the blade platform. The wax turbine blade with the ceramic core is then dipped in a ceramic slurry and allowed to dry. This procedure is repeated several times such that a shell is formed over the wax turbine blade. The wax is then melted out of the shell leaving a mold with a core suspended inside, and into which molten metal is poured. After the metal has solidified the shell is broken away and the core removed to form blade 40. A final machining process may be used to final finish blade 40 to predetermined specified dimensions.

Figure 3:
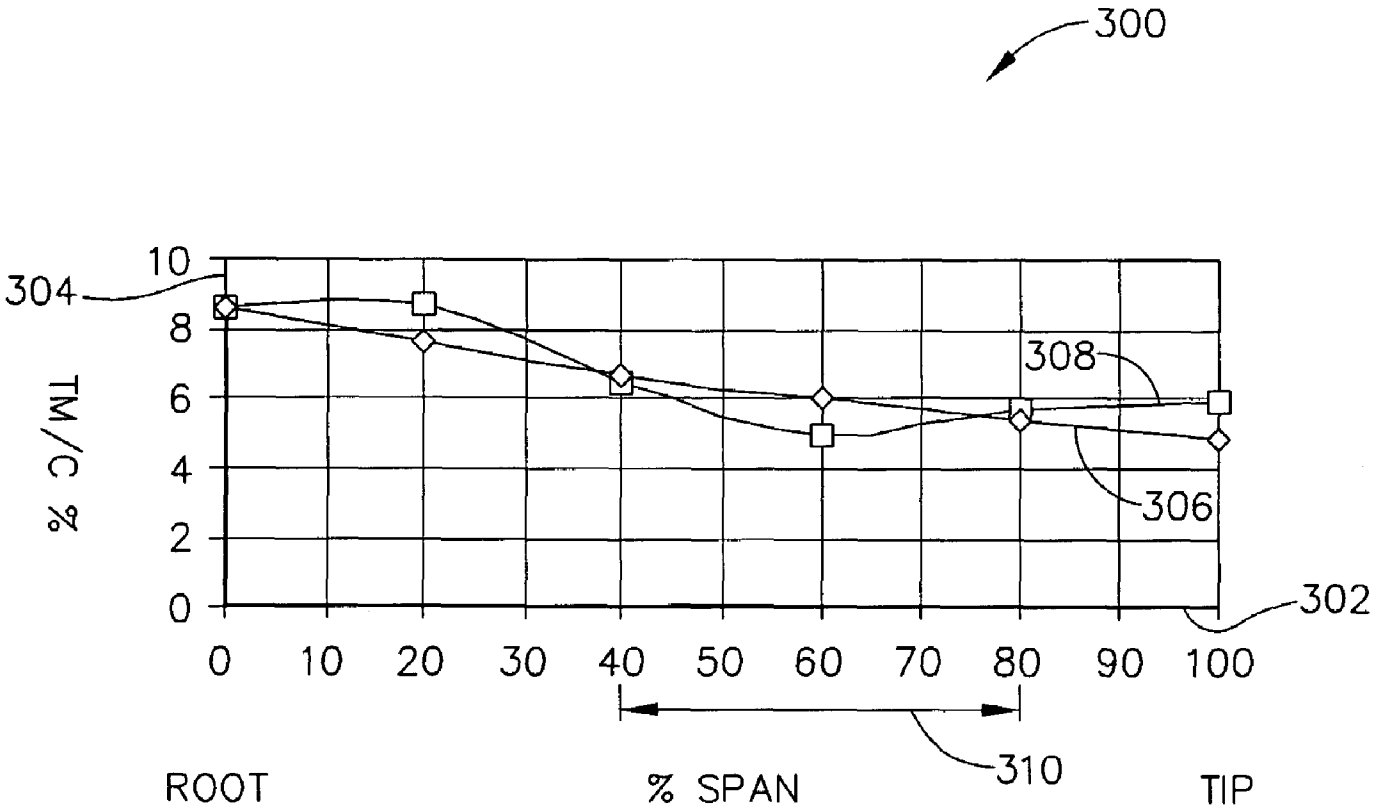
FIG. 3 is a graph of an exemplary $T_{max}$/C profile of the blade shown in FIG. 2.

FIG. 3 is a graph 300 of an exemplary $T_{max}$/C profile of blade 40 fabricated in accordance with an embodiment of the present invention. Graph 300 includes an x-axis 302 that is graduated in increments of percent span of the radial length of blade 40. Zero percent span represents blade 40 proximate blade root 54 and one hundred percent span represents blade 40 proximate airfoil tip 56. Graph 300 also includes a y-axis 304 that is graduated in increments of $T_{max}$/C.

A trace 306 illustrates a $T_{max}$/C distribution versus radial height for a typical blade that is approximately linear, with the root $T_{max}$/C being larger and the tip $T_{max}$/C being smaller. A trace 308 illustrates a $T_{max}$/C distribution versus radial height for blade 40 in accordance with one embodiment of the present invention. In the exemplary embodiment, blade 40 distributes a vibratory stress across a relatively large portion of airfoil 42, and strengthens airfoil 42, while minimizing changes to the blade natural frequencies. For example, a 1-2S mode resonance may be maintained an operating range of blade 40. Additionally, minimizing changes to the blade frequencies compared with the typical blade minimizes the change to the dynamic response of the blade, except for increasing stripe mode strength, which reduces the vibratory stress response in at least some modes, such as 1-2S and 1-3S.

In the exemplary embodiment, a camber and a meanline shape, including a trail edge tip camber, and lean and camber adjustments near the root are sized to provide strengthening of blade 40 while retaining predetermined aerodynamic and operability characteristics. Trace 308 illustrates a radial spanwise maximum thickness distribution that is predetermined to provide vibratory strength of blade 40. A maximum thickness distribution may be reduced at a mid portion span 310, such as, but not limited to, a range between about thirty eight and seventy eight percent of span.

Figure 4:
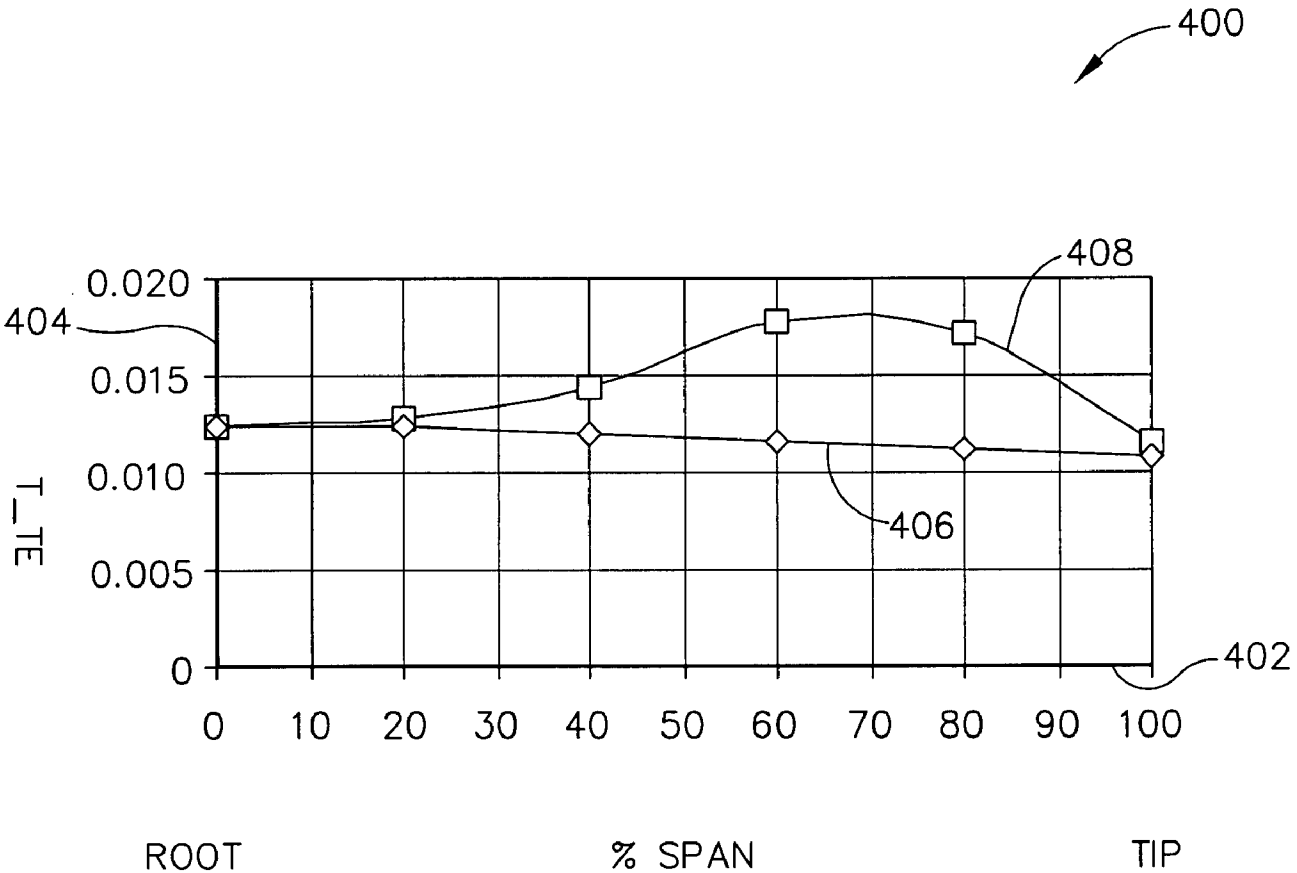
FIG. 4 is a graph of an exemplary trailing edge thickness profile of the blade shown in FIG. 2.

FIG. 4 is a graph 400 of an exemplary trailing edge thickness profile of blade 40 fabricated in accordance with an embodiment of the present invention. Graph 400 includes an x-axis 402 that is graduated in increments of percent span of the radial length of blade 40. Zero percent span represents blade 40 proximate blade root 54 and one hundred percent span represents blade 40 proximate airfoil tip 56. Graph 300 also includes a y-axis 404 that is graduated in increments of inches (mils).

A trace 406 illustrates a trailing edge thickness versus radial height for a typical blade that is approximately linear, with the root trailing edge thickness being larger and the tip trailing edge thickness being smaller. A trace 408 illustrates a trailing edge thickness distribution versus radial height for blade 40 in accordance with one embodiment of the present invention. The trailing edge thickness is increased in the radial span locations where $T_{max}$/C is reduced. For example, $T_{max}$/C is reduced between about thirty eight and seventy eight percent of span relative to the typical blade (shown in FIG. 3). However, the trailing edge thickness is increased within this range relative to the typical blade. For protection against 1-2S mode vibration, the tip $T_{max}$/C is increased, and $T_{max}$/C between about thirty eight and seventy eight percent of span is reduced. Specifically, the value of $T_{max}$/C at mid portion 57 is less than that proximate tip 56. In the exemplary embodiment, the value of $T_{max}$/C at mid portion 57 is reduced to be 1% less than the value proximate tip 56. In alternative embodiments, the specific value may be adjusted to meet the requirements of a specific problem. Modifications to the trailing edge thicknesses permits losses in frequency and strength parameters as a result of the other blade dimensional changes made to be regained.

Figure 5:
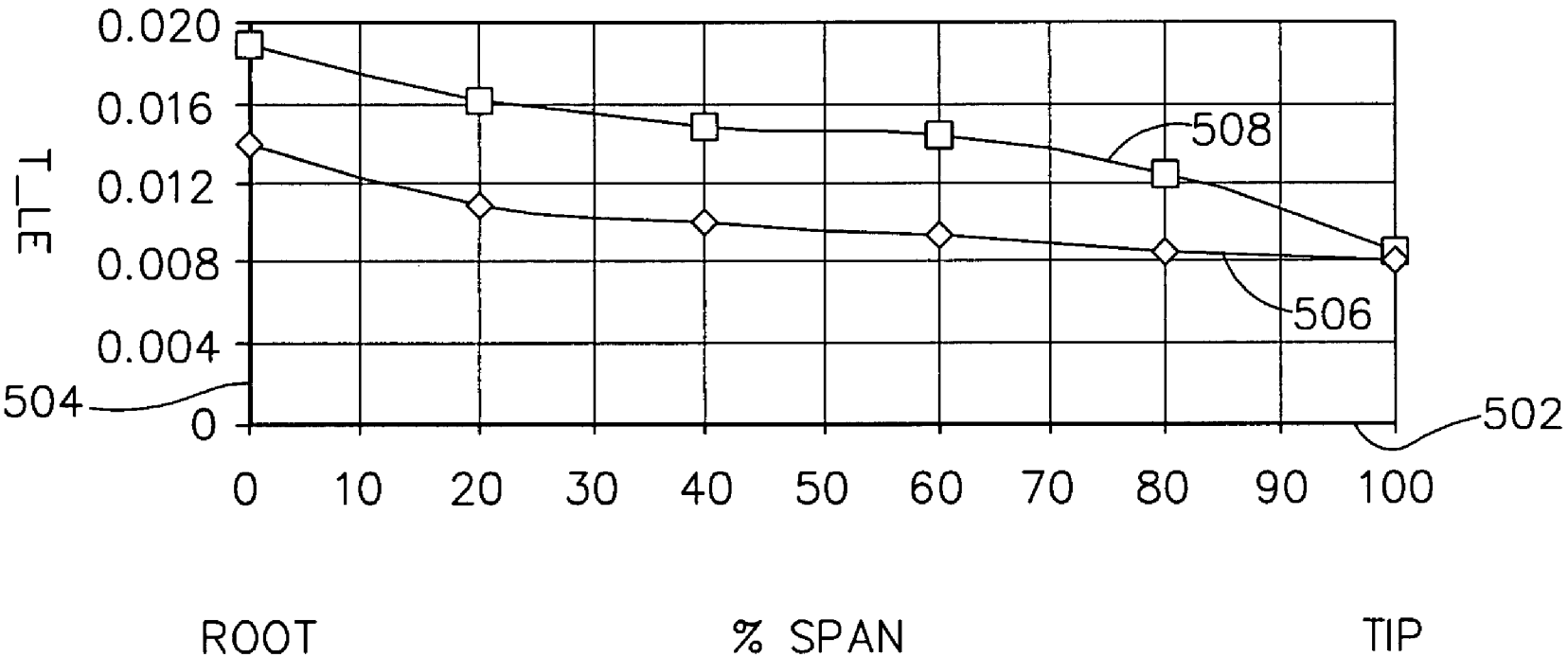
FIG. 5 is a graph of an exemplary leading thickness profile of the blade shown in FIG. 2.

FIG. 5 is a graph 500 of an exemplary leading edge thickness profile of blade 40 fabricated in accordance with an embodiment of the present invention. Graph 500 includes an x-axis 502 that is graduated in increments of percent span of the radial length of blade 40. Zero percent span represents blade 40 proximate blade root 54 and one hundred percent span represents blade 40 proximate airfoil tip 56. Graph 500 also includes a y-axis 504 that is graduated in increments of leading edge thickness.

A trace 506 illustrates a leading edge thickness versus radial height for a typical blade that is approximately linear, with the root leading edge thickness being larger and the tip leading edge thickness being smaller. A trace 508 illustrates a leading edge thickness distribution versus radial height for blade 40 in accordance with one embodiment of the present invention. The leading edge thickness is increased in the radial span locations where $T_{max}/C$ is reduced. For example, $T_{max}/C$ is reduced between about thirty eight and seventy eight percent of span relative to the typical blade (shown in FIG. 3). However, the leading edge thickness is increased within this range relative to the typical blade. For protection against 1-2S mode vibration, the tip $T_{max}/C$ is increased, and $T_{max}/C$ between about thirty eight and seventy eight percent of span is reduced. Specifically, the value of $T_{max}/C$ at mid portion 57 is less than that proximate tip 56. In the exemplary embodiment, the value of $T_{max}/C$ at mid portion 57 is reduced to be 1% less than the value proximate tip 56. In alternative embodiments, the specific value may be adjusted to meet the requirements of a specific problem. Modifications to the leading edge thicknesses permits losses in frequency and strength parameters as a result of the other blade dimensional changes made to be regained.

Figure 6:
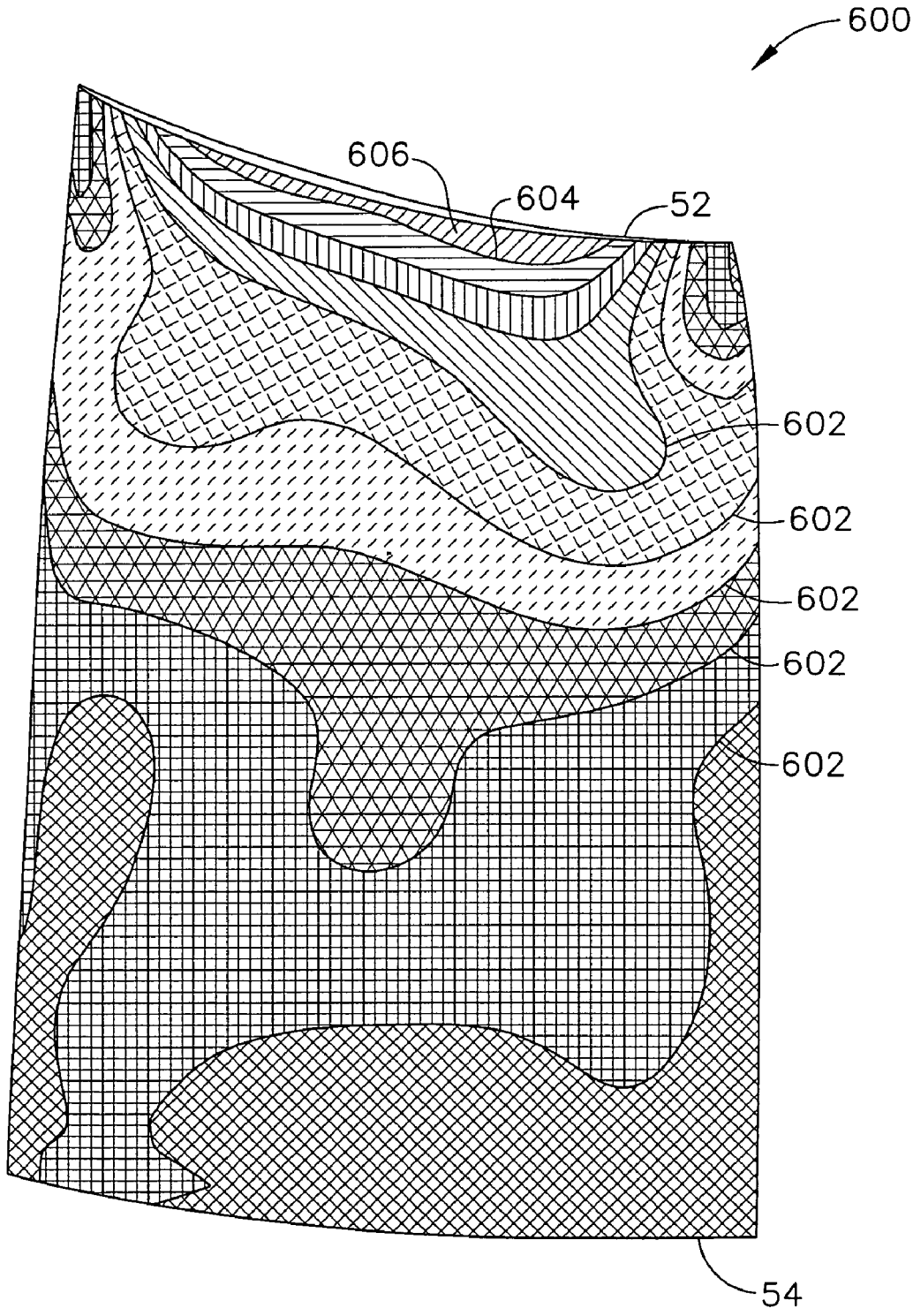
FIG. 6 is an exemplary plot of vibratory stresses for a typical rotor blade.

FIG. 6 is an exemplary plot 600 of vibratory stresses for a typical rotor blade. Stress bands 602 are oriented from airfoil tip 52 to blade root 54 such that a radially outer band 604 surrounds the highest stress level region 606. Stress levels in regions progressively farther from region 606 exhibit less stress than closer to region 606. The stress level regions decrease in magnitude going from region 606 toward, for example a region 608, which is located proximate blade root 54.

Figure 7:
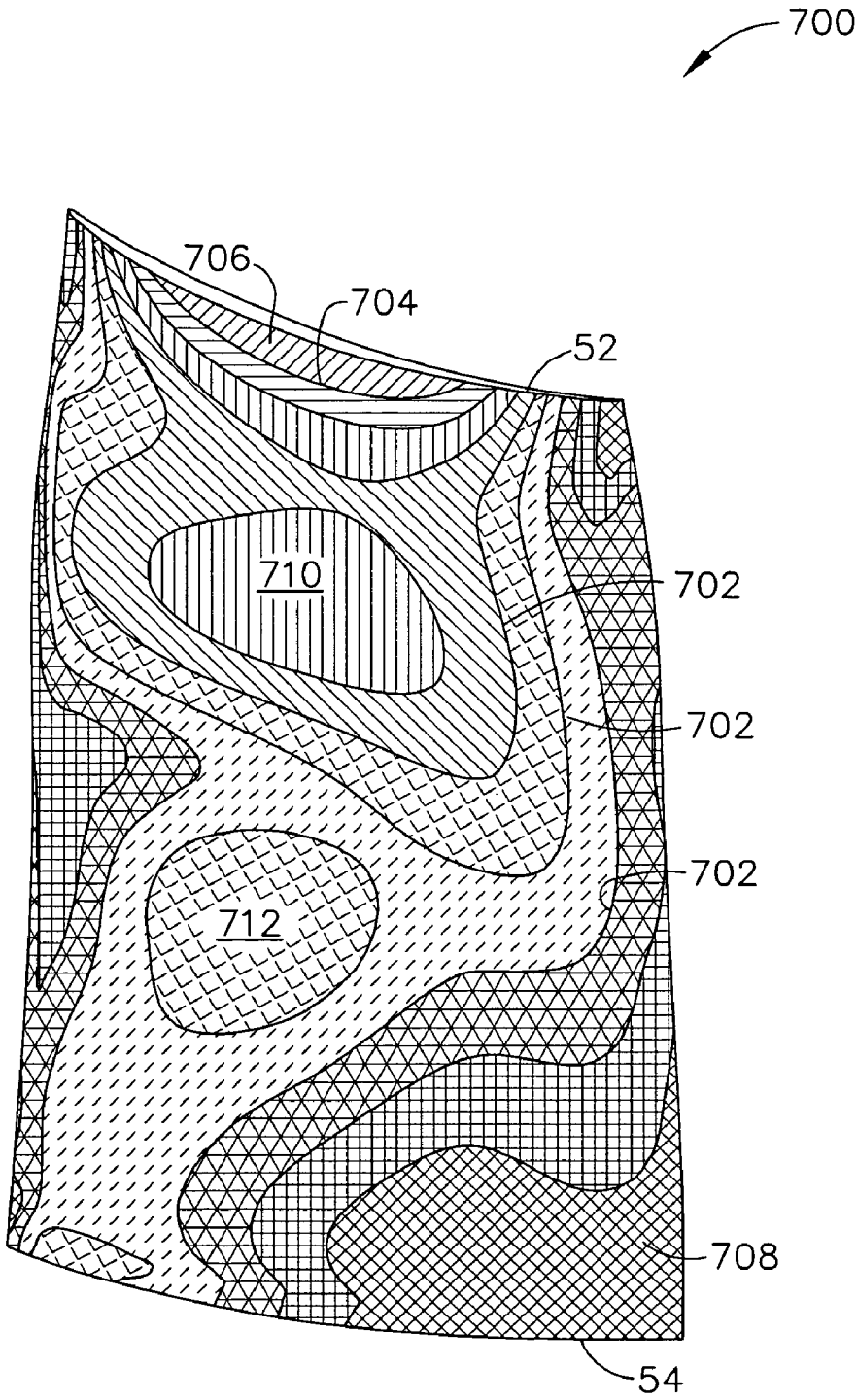
FIG. 7 is an exemplary plot of vibratory stresses for the rotor blade shown in FIG. 2.

FIG. 7 is an exemplary plot 700 of vibratory stresses for rotor blade 40 (shown in FIG. 2). Stress bands 702 are oriented from airfoil tip 52 to blade root 54 such that a radially outer band 704 surrounds the highest stress level region 706. Stress levels in regions progressively farther from region 706 exhibit less stress than closer to region 706. The stress level regions decrease in magnitude going from region 706 toward, for example a region 708, which is located proximate blade root 54. Stress region 710 and 712 exhibit higher stress levels than the corresponding location on the typical blade (shown in FIG. 6). In addition, the stress magnitude of region 704 is reduced relative to region 604. Forming blade 40 having characteristics illustrated in FIGS. 3-5, facilitates reducing a magnitude of stress in airfoil tip 54 by distributing the stress to a larger area in the blade mid portion 57. In addition to 1-2S vibratory modes, fabrication of blade 40 wherein the $T_{max}/C$ profile is modified to address the vibratory stress and the trailing and/or leading edge thicknesses are correspondingly modified to recover strength and/or blade performance losses may be used with other local vibratory modes, such as higher order flex and torsion modes.

Energy induced to airfoil 42 may calculated as the dot product of the force of the exciting energy and the displacement of airfoil 42. More specifically, during operation, aerodynamic driving forces, i.e., wake pressure distributions, are generally the highest adjacent airfoil tip 54 because tip 54 is generally not mechanically constrained. However, the $T_{max}/C$ profile, leading edge thickness profile, and trailing edge thickness profile as shown in FIGS. 3-5 facilitates distributing tip stresses over a larger area of airfoil 42 while strengthening airfoil 42 and minimizing changes to the blade natural frequencies in comparison to similar airfoils that do not include the $T_{max}/C$ profile, leading edge thickness profile, and trailing edge thickness profiles.

The $T_{max}/C$ profile, leading edge thickness profile, and trailing edge thickness profile for fabricating a blade suited for a particular application may be determined using an existing blade geometry such that aerodynamic, vibratory and performance characteristics are known and/or determinable. The blade geometry may then be modified iteratively in relative small increments while maintaining the blade characteristics within predetermined specifications. Specifically, a natural frequencies of the blade may be desired to be maintained to within 5-10%, depending on the mode and an expected and/or measured response. A stress to square root of energy ratio in key modes may be reduced and validated using a detailed analytical code (Forced Response). The stress to square root of energy ratio in other modes and the blade weight may be maintained within predetermined specifications. In the exemplary embodiment, the iteration provided for an increase in $T_{max}/C$ at and proximate airfoil 52, which facilitated in strengthening the tip. The $T_{max}/C$ at mid-span, for example, proximate 60% span, is reduced to spreads stripe mode stresses radially inward on the blade. The edge thicknesses at mid span are increased such that blade frequencies and stress to square root of energy ratio is maintained. Near the blade root the $T_{max}/C$ is relatively moderately increased while the $T_{max}/C$ at the blade root is maintained such that support for the extra tip mass is provided and to compensate for the reduced mid-span mass.

Figure 8:
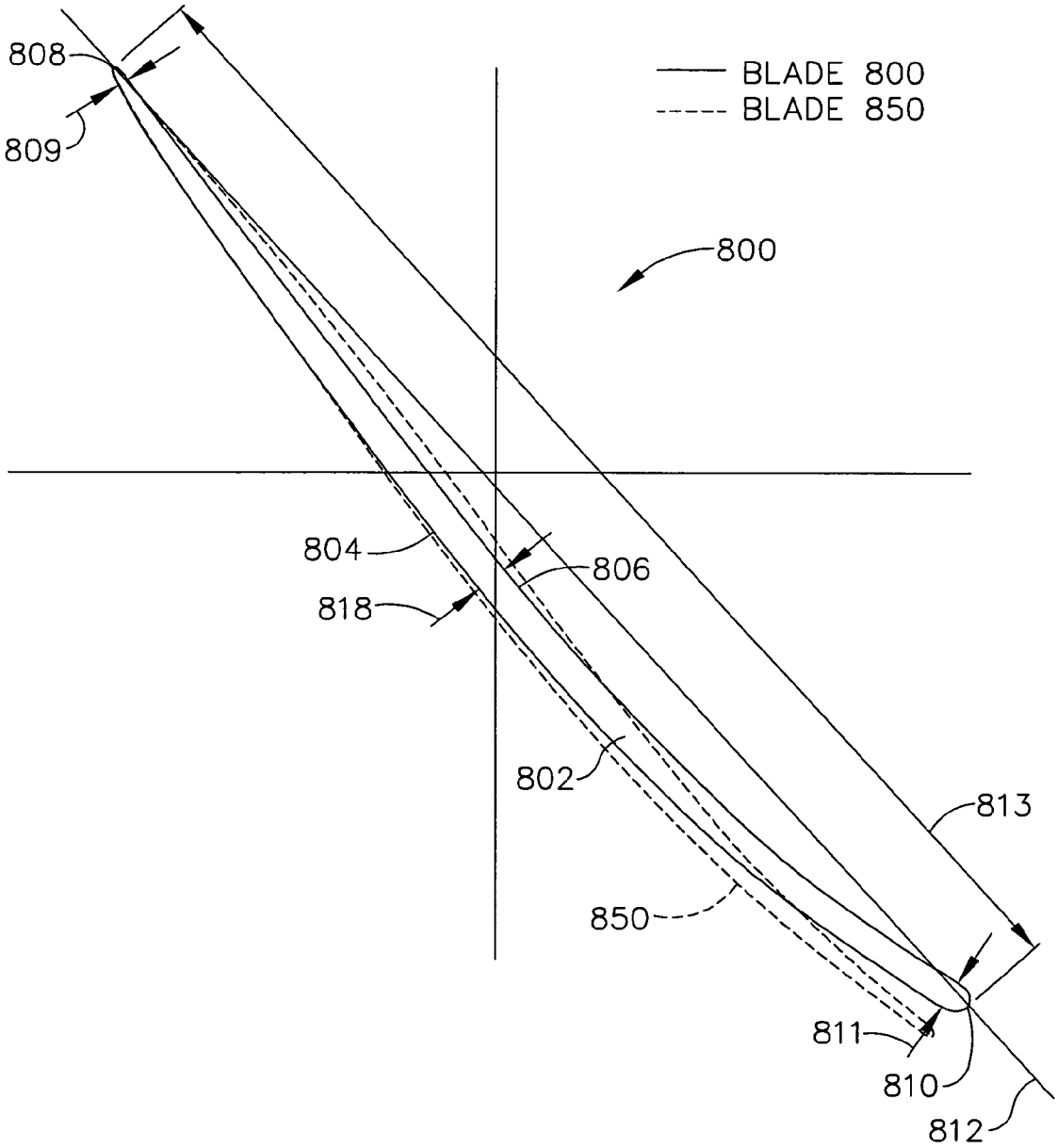
FIG. 8 is a cross-sectional view of an exemplary rotor blade, viewed tipwise, that may be used with a gas turbine engine, such as the gas turbine engine shown in FIG. 1.

FIG. 8 is a cross-sectional view of an exemplary rotor blade 800, viewed tipwise, that may be used with a gas turbine engine, such as gas turbine engine 10 (shown in FIG. 1). In one embodiment, a plurality of rotor blades 800 form a high pressure compressor stage (not shown) of gas turbine engine 10. Each rotor blade 800 includes an airfoil 802 having a first contoured sidewall 804 and a second contoured sidewall 806. First sidewall 804 is convex and defines a suction side of airfoil 802, and second sidewall 806 is concave and defines a pressure side of airfoil 802. Sidewalls 804 and 806 are joined at a leading edge 808 having a thickness 809 and at an axially-spaced trailing edge 810 having a thickness 811. A chord 812 of airfoil 802 includes a chord length 813 that represents the distance from leading edge 808 to trailing edge 50. More specifically, airfoil trailing edge 810 is spaced chordwise and downstream from airfoil leading edge 808. First and second sidewalls 804 and 806, respectively, extend longitudinally or radially outward in span from a blade root (not shown) to the airfoil tip. A maximum thickness 818 of airfoil 802 may be defined as the value of the greatest distance between sidewalls 804 and 806 at the tip of blade 800. A midpoint of chord 812 may coincide with the location of maximum thickness 818. In the exemplary embodiment, the midpoint of chord 812 and the location of maximum thickness 818 are not coincident. Leading edge thickness 809 and trailing edge thickness 811 may be defined as the value of the distance between sidewalls 804 and 806 at a predefined location adjacent leading edge 808 and trailing edge 810, respectively.

A shape of blade 800 may be at least partially defined using chord length 813, maximum thickness 818 (Tmax), leading edge thickness 809, trailing edge thickness 811, and a camber of blade 800.

A cross-sectional view of another exemplary rotor blade 850, viewed tipwise, overlays the view of blade 800. Blade 850 may represent a preliminary design or model comprising known parameters and known responses to external stimuli. Blade 850 may be used to refine a design to accommodate differing stimuli and/or responses. Generally, blade 850 includes a cross-sectional profile that is more narrow at the leading edge than blade 800, thicker near the midpoint of chord 812, and narrower at the trailing edge. Additionally, a camber or curvature of blade 850 is less that that of blade 800, at the trailing edge.

Figure 9:
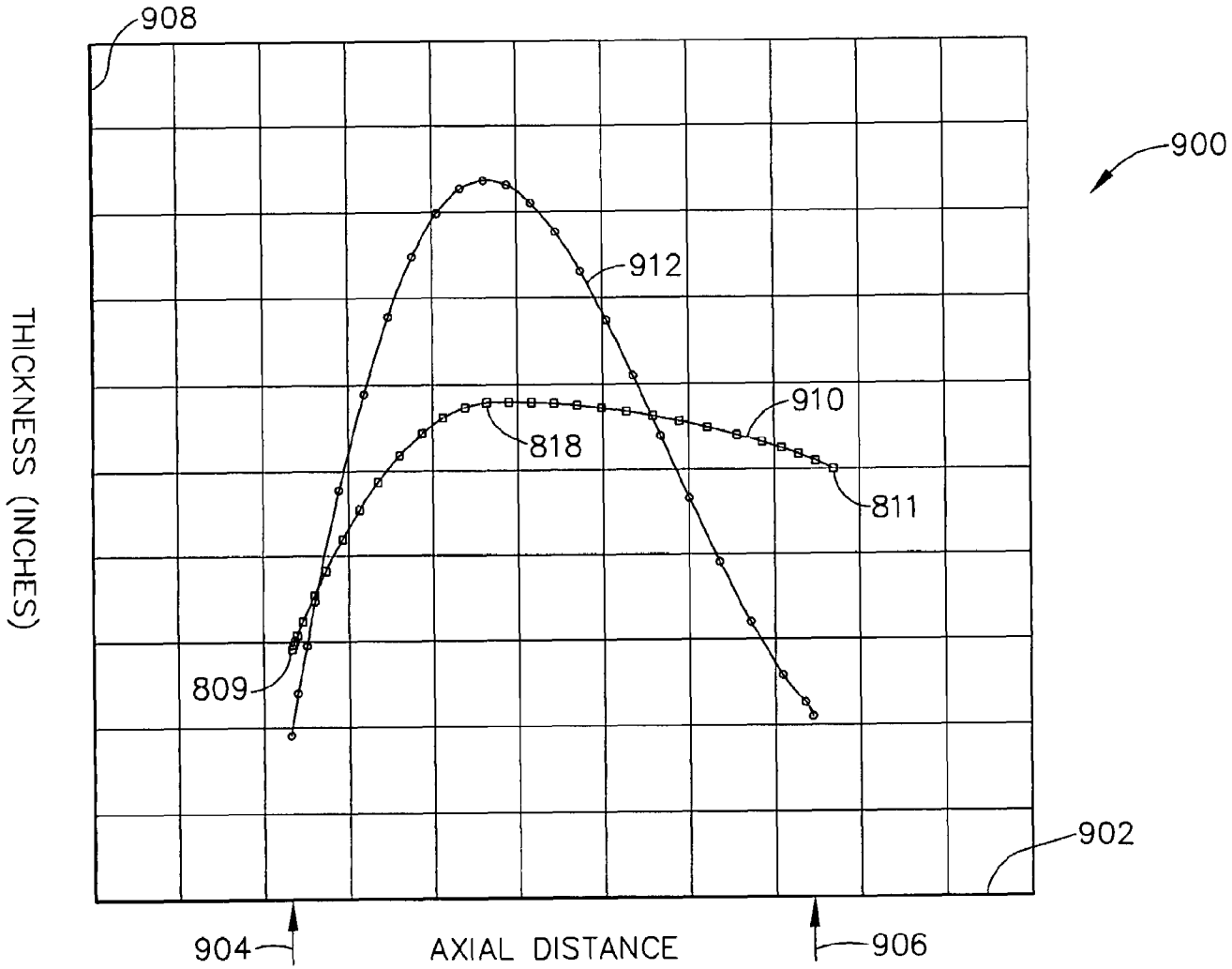
FIG. 9 is a graph of an exemplary profile of thickness from the leading edge to the trailing edge of the blade fabricated in accordance with an embodiment of the present invention.

FIG. 9 is a graph 900 of an exemplary profile of thickness from leading edge 808 to trailing edge 810 of blade 800 fabricated in accordance with an embodiment of the present invention, and blade 850. Graph 900 includes an x-axis 902 that is graduated in increments of axial distance across the blades from a leading edge position 904 to a trailing edge position 906. Graph 900 also includes a y-axis 908 that is graduated in increments of blade tip thickness.

A trace 910 illustrates a thickness profile of blade 800 adjacent the tip of blade 800. A trace 912 illustrates a thickness profile of blade 850 adjacent the tip of blade 850. In the exemplary embodiment, leading edge thickness 809 is approximately 0.019 inches and a corresponding thickness for blade 850 is approximately 0.009. From leading edge thickness 809, trace 910 increases asymptotically to approximately maximum thickness 818 and then decreases substantially linearly to trailing edge thickness 811.

The design of blade 800 is generally configured to facilitate reducing cracking in the blade trailing edge that are due to, for example 1-3S mode vibration. Rather than adding thickness or reducing chord length to increase a frequency of the stripe mode response, trailing edge thickness 811 is increased to add strength to blade 800 in the 1-3S mode. To maintain 1-3S and other modes placement maximum thickness 818 is decreased, and the camber of blade 800 adjacent trailing edge 810 is increased, which acts to compensate for the additional blade thickness. Generally, significant local camber increase local vibratory stresses however, increasing trailing edge thickness 811 in the area of the significant local camber desensitizes blade 800 to the increase in camber.

In general, blade thickness is decreased in the midchord area and blade thickness is increased in the trailing edge area, and the local camber in the trailing edge area is increased. Such changes facilitate adding strength, minimizing the tendency tend increasing the natural frequency caused by the increased thickness and permits camber to be increased to retain a level of performance that would otherwise have been reduced due to the change in shape of blade 800. Accordingly, In the exemplary embodiment, trailing edge thickness 811 is greater than leading edge thickness 809. In various embodiments of the present invention trailing edge thickness 811 may be approximately 10% to approximately 100% greater than leading edge thickness 809. Maximum thickness 818 may be approximately equal to the thickness of blade 800 at the midpoint of chord 812, less than approximately 150% greater than leading edge thickness 809, and less than 25% greater than trailing edge thickness 811. Specifically, in the exemplary embodiment, maximum thickness 818 is approximately 0.048 inches, leading edge thickness 809 is approximately 0.019 inches, midchord thickness is approximately 0.047 inches, and trailing edge thickness 811 is approximately 0.04 inches.

The above-described exemplary embodiments of rotor blades are cost-effective and highly reliable. The rotor blade includes $T_{max}$/C profile, leading edge thickness profile, and trailing edge thickness profiles that facilitates distributing blade tip stresses over a larger area of the airfoil while strengthening the airfoil and minimizing changes to the blade natural frequencies. As a result, the described profiles facilitate maintaining aerodynamic performance of a blade, while providing aeromechanical stability to the blade, in a cost effective and reliable manner.

Exemplary embodiments of blade assemblies are described above in detail. The blade assemblies are not limited to the specific embodiments described herein, but rather, components of each assembly may be utilized independently and separately from other components described herein. Each rotor blade component can also be used in combination with other rotor blade components.

While the invention has been described in terms of various specific embodiments, those skilled in the art will recognize that the invention can be practiced with modification within the spirit and scope of the claims.

What is claimed is:

1. A method for fabricating a rotor blade for a gas turbine engine wherein the rotor blade includes an airfoil including a first sidewall and a second sidewall connected at a leading edge and at a trailing edge, a root portion at a zero percent radial span and a tip portion at a one hundred percent radial span, the airfoil having a radial span dependent chord length C, a respective maximum thickness $T_{max}$, and a maximum thickness to chord length ratio ($T_{max}$/C ratio), said method comprises:

determining a blade geometry that facilitates reducing a vibratory stress of the blade; and casting the rotor blade such that a root portion is formed having a first $T_{max}$/C ratio, a tip portion is formed having a second $T_{max}$/C ratio, and a mid portion, extending between the root portion and the tip portion, is formed having a third $T_{max}$/C ratio, the third $T_{max}$/C ratio being less than the first $T_{max}$/C ratio and less than the second $T_{max}$/C ratio, wherein the trailing edge is tapered and has a first thickness at about zero percent of span and a second thickness at about seventy percent of span.

2. A method in accordance with claim 1 wherein casting the rotor blade further comprises:

forming the root portion such that the first $T_{max}$/C ratio is greater than about 0.08;

forming the tip portion such that the second $T_{max}$/C ratio is greater than about 0.06; and forming the mid portion centered at about sixty percent span such that the third T.sub.max/C ratio is less than about 0.05.

3. A method in accordance with claim 1 further comprising forming the trailing edge having a thickness that is tapered such that a thickness of said trailing edge decreases from the second thickness at about seventy percent of span to a third thickness at about one hundred percent span.

4. A method in accordance with claim 1 further comprising forming the leading edge having a first thickness at about zero percent of span, the leading edge thickness is tapered such that a thickness of said leading edge increases to a second thickness at about one hundred percent of span.

5. A method in accordance with claim 1 further comprising forming the leading edge having a first thickness at about zero percent of span, the leading edge thickness is tapered such that a thickness of said leading edge decreases continuously to a second thickness at about one hundred percent of span.

6. A method in accordance with claim 1 further comprising forming the tip portion with a greater $T_{max}$/C ratio than the mid portion such that stripe mode stresses are facilitated being distributed over the tip portion and the mid portion.

7. A method in accordance with claim 1 further comprising forming the tip portion with a greater $T_{max}$/C ratio than the mid portion such that stripe mode stresses are facilitated being reduced proximate the tip portion.

8. An airfoil for a gas turbine engine, said airfoil comprising a radial span dependent chord length C, a respective maximum thickness T, and a maximum thickness to chord length ratio ($T_{max}$/C ratio), said airfoil further comprising:

a first sidewall;

a second sidewall coupled to said first sidewall at a leading edge and at a trailing edge, said trailing edge tapered such that a thickness of said trailing edge increases from about zero percent span to about seventy percent span;

a root portion comprising a first $T_{max}/C$ ratio;

a tip portion comprising a second $T_{max}/C$ ratio; and a mid portion extending between said root portion and said tip portion, said mid portion comprising a third $T_{max}/C$ ratio that is less than the first $T_{max}/C$ ratio and the second $T_{max}/C$ ratio.

9. An airfoil in accordance with claim 8 wherein said first $T_{max}/C$ ratio is greater than about 0.08, said second $T_{max}/C$ ratio is greater than about 0.06, and said third $T_{max}/C$ ratio is less than about 0.05.

10. An airfoil in accordance with claim 8 wherein said trailing edge is tapered such that a thickness of said trailing edge decreases from about seventy percent span to about one hundred percent span.

11. An airfoil in accordance with claim 8 wherein said leading edge is tapered such that a thickness of said leading edge decreases from about zero percent span to about one hundred percent span.

12. An airfoil in accordance with claim 11 further comprising forming the leading edge having a thickness that continuously decreases from about zero percent span to about one hundred percent span.

13. An airfoil in accordance with claim 8 further comprising forming the tip portion with a greater $T_{max}/C$ ratio than the mid portion such that stripe mode stresses are facilitated being distributed over the tip portion and the mid portion.

14. An airfoil in accordance with claim 8 further comprising forming the tip portion with a greater $T_{max}/C$ ratio than the mid portion such that stripe mode stresses are facilitated being reduced proximate the tip portion.

15. A gas turbine engine comprising a plurality of rotor blades, each said rotor blade comprising an airfoil comprising a radial span dependent chord length C, a respective maximum thickness T, and a maximum thickness to chord length ratio ($T_{max}/C$ ratio), said airfoil comprising:

a first sidewall;

a second sidewall coupled to said first sidewall at a leading edge and at a trailing edge, said trailing edge comprises a first thickness at about zero percent span, a second thickness at about one hundred percent of span, and a maximum thickness at about seventy percent of span;

a root portion at a zero percent radial span having a first $T_{max}/C$ ratio; a tip portion at a one hundred percent radial span having a second $T_{max}/C$ ratio; and a mid portion extending between said root portion and said tip portion having a third $T_{max}/C$ ratio, the third $T_{max}/C$ ratio that is less than the first $T_{max}/C$ ratio and the second $T_{max}/C$ ratio.

16. A gas turbine engine in accordance with claim 15 wherein said first $T_{max}/C$ ratio is greater than about 0.08, said second $T_{max}/C$ ratio is greater than about 0.06, and said third $T_{max}/C$ ratio is less than about 0.05.

17. A gas turbine engine in accordance with claim 15 wherein said leading edge comprises a thickness that continuously decreases from a first leading edge thickness at about zero percent of span to a second leading edge thickness at about one hundred percent of span.

18. An airfoil for a gas turbine engine, said airfoil comprising:

a first sidewall extending between a root portion and a tip portion; and a second sidewall extending between said root portion and said tip portion, said second sidewall coupled to said first sidewall at a leading edge and at a trailing edge;

said airfoil comprising a maximum thickness, a leading edge thickness, a midchord thickness, and a trailing edge thickness wherein said trailing edge thickness is greater than said leading edge thickness, wherein each of said thicknesses is measured between said first and said second sidewalls.

19. An airfoil in accordance with claim 18 wherein said trailing edge thickness is at least 10% greater than said leading edge thickness.

20. An airfoil in accordance with claim 19 wherein said trailing edge thickness is at least 50% greater than said leading edge thickness.

21. An airfoil in accordance with claim 20 wherein said trailing edge thickness is approximately 100% greater than said leading edge thickness.

22. An airfoil in accordance with claim 18 wherein said maximum thickness is approximately equal to said midchord thickness.

23. An airfoil in accordance with claim 18 wherein said maximum thickness is less than 150% greater than said leading edge thickness.

24. An airfoil in accordance with claim 18 wherein said maximum thickness is less than 25% greater than said trailing edge thickness.

25. An airfoil in accordance with claim 18 wherein said maximum thickness is approximately 0.048 inches, said leading edge thickness is approximately 0.019 inches, said midchord thickness is approximately 0.047 inches, and said trailing edge thickness is approximately 0.04 inches.

* * * * *